US009202359B2

(12) United States Patent
Rauworth et al.

(10) Patent No.: US 9,202,359 B2
(45) Date of Patent: Dec. 1, 2015

(54) MULTILEVEL SIGNALING SYSTEM AND METHOD

(75) Inventors: Timothy A. Rauworth, West Chicago, IL (US); Fred Nathan Merkle, Chicago, IL (US); Deborah Renee Taylor, Gilly (CH); Robert J. Selepa, Naperville, IL (US)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 174 days.

(21) Appl. No.: 13/599,454

(22) Filed: Aug. 30, 2012

(65) Prior Publication Data

US 2014/0062705 A1 Mar. 6, 2014

(51) Int. Cl.

| | |
|---|---|
| ***G08B 17/10*** | (2006.01) |
| ***G08B 29/00*** | (2006.01) |
| ***G08B 21/00*** | (2006.01) |
| ***G08B 19/00*** | (2006.01) |
| ***G08B 17/04*** | (2006.01) |
| ***G08B 21/14*** | (2006.01) |
| ***G08B 21/02*** | (2006.01) |
| *G08B 29/18* | (2006.01) |

(52) U.S. Cl.

CPC ..... *G08B 17/04* (2013.01); *G08B 17/10* (2013.01); *G08B 21/02* (2013.01); *G08B 21/14* (2013.01); *G08B 29/188* (2013.01)

(58) Field of Classification Search

CPC .... G08B 17/10; G08B 17/107; G08B 17/117; G08B 23/00; G08B 26/00; G08B 29/02; G08B 17/125; G08B 21/02; G08B 21/00; G08B 17/00; G08B 17/12; G08B 25/10; G08B 7/06; G08B 25/007; G08B 29/185; G08B 29/188; G08B 17/103; G08B 17/11; G08B 29/22; G08B 29/183; G08B 29/12; G08B 29/145; G08B 3/1025; G08B 21/16; G08B 25/00; G08B 29/16; G08B 29/20; G01D 21/02; G01D 7/002; C10G 15/08; G01N 21/53

USPC ..... 340/632, 540, 662, 510, 511, 588, 522, 340/628, 577, 506, 691, 407.1, 692, 286.02, 340/538; 364/557, 572, 724.01, 422; 348/162, 143, 154

See application file for complete search history.

(56) References Cited

U.S. PATENT DOCUMENTS

| | | | | |
|---|---|---|---|---|
| 5,969,604 | A * | 10/1999 | Tice | 340/506 |
| 6,150,935 | A * | 11/2000 | Anderson | 340/506 |
| 2002/0118116 | A1* | 8/2002 | Tice et al. | 340/632 |
| 2003/0234732 | A1* | 12/2003 | Rhodes et al. | 340/870.16 |
| 2004/0145465 | A1* | 7/2004 | Stults et al. | 340/521 |
| 2010/0141461 | A1* | 6/2010 | Morita et al. | 340/636.15 |
| 2012/0229285 | A1 | 9/2012 | Rauworth et al. | |

* cited by examiner

*Primary Examiner* — Mirza Alam
(74) *Attorney, Agent, or Firm* — Husch Blackwell LLP

(57) ABSTRACT

A fire detecting system can mix fire detectors, such as smoke, flame, or, thermal detectors on a common loop, or zone, with gas detectors. Signals indicative of gas can have one amplitude while those indicating fire can have a different amplitude. Duty cycles can be varied to indicate other conditions, such as trouble conditions.

17 Claims, 2 Drawing Sheets

MULTILEVEL SIGNALING SYSTEM AND METHOD

FIELD

The application pertains to detectors and alarm systems where different types of detectors can be readily installed on a common loop or zone. More particularly, the application pertains to such detectors and systems wherein differing signal amplitudes and durations are used to indicate the presence of different conditions.

BACKGROUND

Installation problems exist at times where a need develops to retrofit a system connected gas detector, for example, a CO detector, into an existing alarm system. An installer may have to pull a multi-conductor cable from the installation point back to the control panel. This process can be both expensive and inconvenient.

It would be useful to be able to install gas detectors, or combination gas and fire detectors on an existing zone or loop with previously installed fire detectors without needing to pull additional wires.

DETAILED DESCRIPTION

Figure 1:
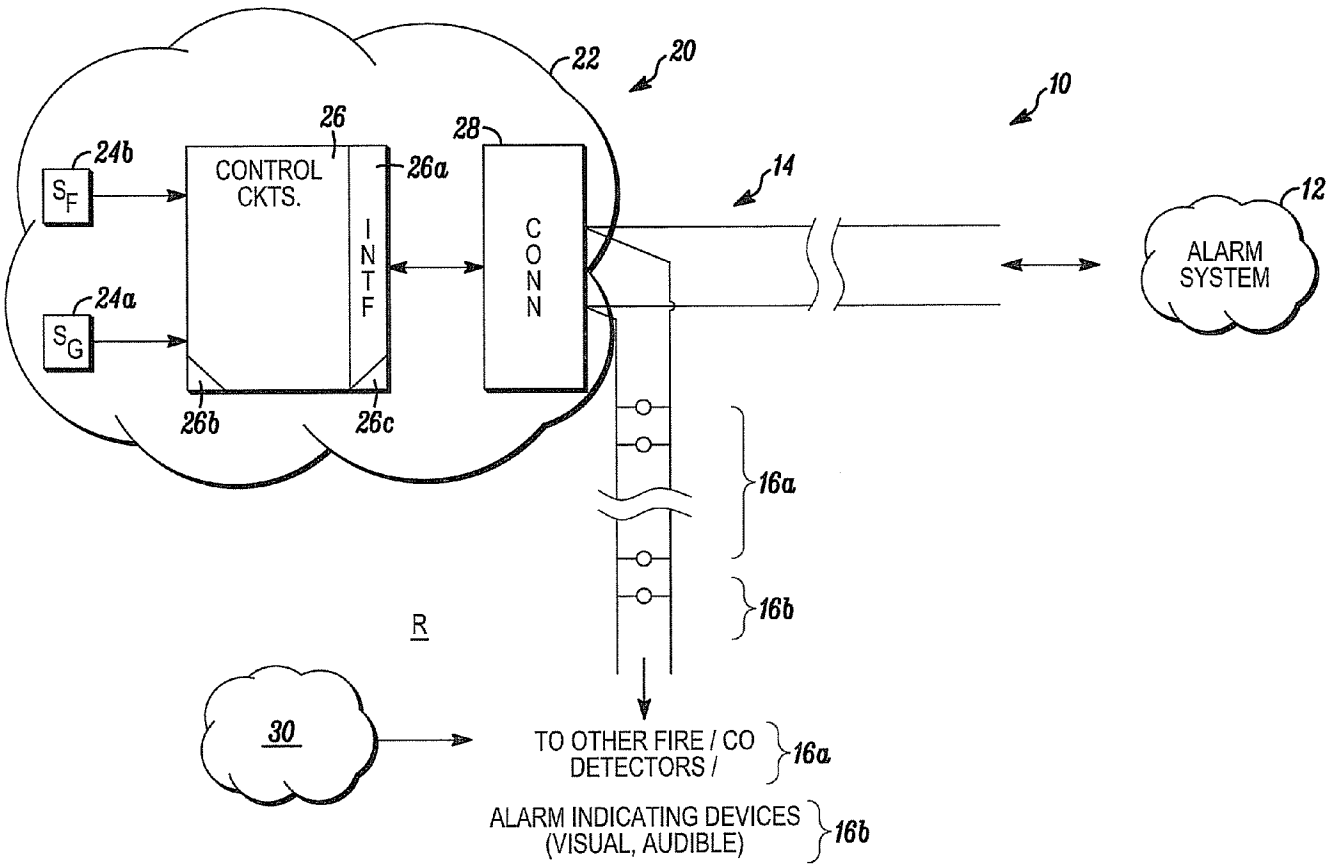
FIG. 1 is a block diagram of an embodiment hereof.

While embodiments can take many different forms, specific embodiments thereof are shown in the drawings and will be described herein in detail with the understanding that the present disclosure is to be considered as an exemplification of the principles hereof, as well as the best mode of practicing same. No limitation to the specific embodiment illustrated is intended.

In embodiments hereof, gas detectors can be added to existing fire, wired, detection systems without having to add additional wiring to take into account different signal values associated with detected gases, or trouble indicators from the respective gas detectors. In accordance herewith, the respective gas detectors, or the gas detection portion of a new, or additional, combination gas/fire detector, will clamp, or assert, an open circuit voltage on the loop, for example 12 volts, to a lower voltage, perhaps 10 volts, which is above the expected minimum operating voltage of the fire directors, which may be on the order of 8.5 volts.

Advantageously, both gas alarm signals, and trouble signals associated with gas detectors can be indicated to a respective alarm system control element, or panel, by asserting a single predetermined voltage. A singular amplitude level can be combined with varying duty cycles to indicate either the detected presence of a gas or a trouble condition. Where the selected voltage amplitude is between the loop's normal open circuit voltage and the minimum operating voltage of the associated fire detectors, the gas detector related signaling is transparent to the operation of the associated fire detectors.

In one aspect hereof, additional gas or combination gas/fire detectors can be added to a system of previously installed fire detectors using the same signaling loop. Separate wiring for the gas detectors, or the gas sensing portion of combination gas/fire detectors is not needed. Visual or audible signaling devices, or sounders, coupled to the loop can be activated independently as needed by reversing the polarity of the voltage applied to the loop.

FIG. 1 illustrates an embodiment 10 of a system in accordance herewith. System 10 includes a fire alarm system 12 of a conventional type to which can be coupled a two wire loop 14 which extends into a region R being monitored. Fire detectors along with gas detectors, or combined gas/fire detectors, indicated at 16*a*, and audible or visual alarm indicating signaling devices, indicated at 16*b*, can all be coupled to the loop 14.

A representative combination fire and gas detector 20 is illustrated coupled to the loop 14. It will be understood that neither the number of detectors, such as 16*a*, or 20, nor the number of signaling devices such as 16*b* which are coupled to the loop 14 are limitations hereof. Further, neither type of fire sensors such as smoke, heat or the like or the type of gas sensors, such as electrochemical, or semiconductor based, are limitations hereof.

Representative detector 20 includes a housing 22 which encloses and carries components such as a gas sensor 24*a*, and an optional fire sensor 24*b*. It will be understood that multiple gas or fire sensors can be carried in housing 20 without departing from the spirit and scope hereof.

Control circuits 26 can receive signals from the sensors 24*a, b* for local processing or analysis. Control circuits 26 can include interface circuitry 26*a*, which could be bidirectional. Connectors 28 coupled to the interface circuits 26*a* can couple the detector 20 to the loop 14.

The control circuits 26 can be implemented, at least in part, with a programmable processor 26*b* and associated control software 26*c* stored on non-volatile memory or storage units in the circuitry 26.

Figure 2A:
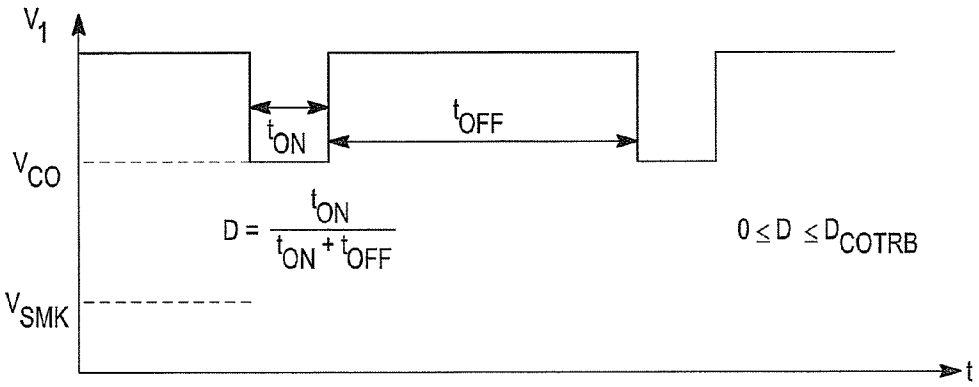
FIG. 2A is a graph indicating a first signaling condition.
Figure 2B:
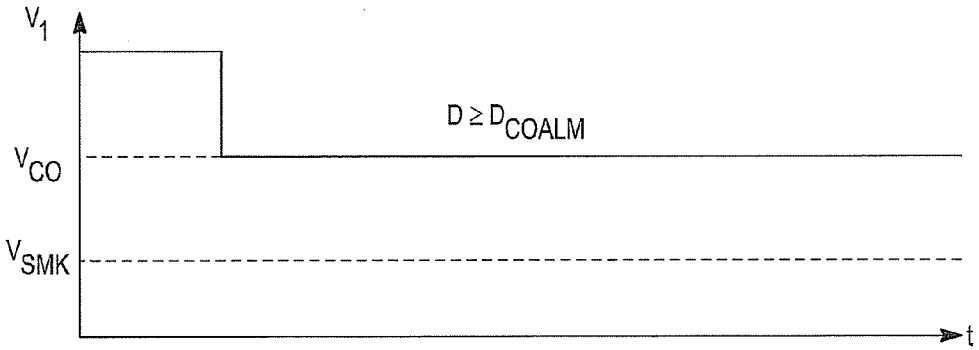
FIG. 2B is a different graph indicating a second signaling condition.

Signaling patterns associated with detector 20 are illustrated in the graphs of FIGS. 2A, 2B. An open circuit voltage V1 can be coupled to loop 14 by the alarm system 12. The particular value of V1 is not a limitation hereof so long as V1 exceeds a minimum voltage Vsmk needed to activate the smoke detectors on the loop 14.

For example, where V1 is on the order of 12 volts and the minimum smoke detector operating voltage is 8-8.5 volts, the voltage amplitude associated with gas sensing functions, Vco can be on the order of ten volts.

Where a fire condition is sensed, at sensor 24*b*, or at any other smoke detector on the loop 14, the interface 26*a*, or corresponding circuitry in the detector sensing the fire condition, clamps the voltage on the loop 14 to a value below the smoke indicating threshold at the system 12, for example, 3 volts or less. The presence of the gas sensor 24*a* and its signaling has no effect on detection of smoke, heat, flames or the like.

At detector 20 gas sensor related signaling asserts a common voltage amplitude Vco, on the loop 14, where either a selected gas such as carbon monoxide is sensed, or the gas sensing portion of detector 20 is exhibiting at trouble condition. Different duty cycles are used to distinguish the presence of a gas trouble condition, from a gas present condition. In FIG. 2A a gas related trouble condition can be indicated to system 12 by pulsing the loop 14, via interface 26*a* for a time interval less than a predetermined value. Where the duty cycle on the loop 14 is greater than zero, and less than a predetermined value, such as Dcotrb, the system 12 can detect a gas, or CO trouble condition. To assert a gas, or CO alarm, the detector 20 asserts the CO indicating voltage Vco continuously, as in FIG. 2B.

In summary, as described above and illustrated in the figures, a common amplitude value, in combination with predetermined duty cycle thresholds can be used to indicate the presence of gas, or a gas related trouble condition at a detector without impacting operation of the fire detectors present on the loop. Additional gas detectors, such as detector 30, can thus be added to an existing alarm system using the existing loops, and installed fire detectors without needing separate loops, or cable runs for the later installed gas detectors.

From the foregoing, it will be observed that numerous variations and modifications may be effected without departing from the spirit and scope hereof. It is to be understood that no limitation with respect to the specific apparatus illustrated herein is intended or should be inferred. It is, of course, intended to cover by the appended claims all such modifications as fall within the scope of the claims.

The invention claimed is:

1. A detector comprising:

an ambient condition sensor; and control circuits coupled to the sensor;

wherein the control circuits include an interface that interacts with a control panel through a two-wire loop having a plurality of other associated ambient condition sensors, where the control circuits are coupled between the ambient condition sensor and the two-wire loop, where, in response to a first condition, the interface transmits a first signal having a first amplitude and a first duty cycle, the first duty cycle being less than a predetermined value, where, in response to a detected ambient condition, the interface transmits a second signal having the first amplitude and a second duty cycle, the second duty cycle being greater than the predetermined value, and where the first amplitude is between a normal open circuit voltage of the two-wire loop and a minimum operating voltage of the other associated ambient condition sensors, the detector relating signaling of the first and second signals is transparent to operation of the other associated ambient condition sensors.

2. The detector as in claim 1 where the sensor comprises one of at least a fire sensor, or a gas sensor.

3. The detector as in claim 1 which includes a second, different sensor where one sensor is a gas sensor and the other is a fire sensor, where responsive to at least one of the sensors, the interface transmits one of the first signal or the second signal.

4. The detector as in claim 3 where the interface transmits the second signal in a presence of a detected gas, and transmits a third signal having a second amplitude in a presence of a detected fire, where the second amplitude is lower than the first amplitude.

5. The detector as in claim 4 wherein the first condition is indicative of a trouble condition, different from the presence of the detected gas or the presence of the detected fire.

6. The detector as in claim 5 which includes a connector coupled to the interface, where the connector includes terminals for releasably coupling the detector to a monitoring loop.

7. A method comprising:

an ambient condition sensor sensing one of a presence of a selected ambient condition, or a trouble indicating condition;

responsive to sensing the presence of the selected ambient condition, the ambient condition sensor providing a first condition indicating signal having a first amplitude and a first duty cycle;

responsive to sensing the trouble indication condition, the ambient condition sensor providing a second condition indicating signal having the first amplitude and a second duty cycle; and coupling the provided first and second condition indicating signals from the ambient condition sensor to a control panel through a two-wire loop having a plurality of other associated ambient condition sensors, wherein the first duty cycle is different from the second duty cycle, and wherein the first amplitude is between a normal open circuit voltage of the two-wire loop and a minimum operating voltage of the other associated ambient condition sensors, the ambient condition relating signaling of the first and second signals is transparent to operation of the other associated ambient condition sensors.

8. The method as in claim 7 further comprising sensing at least a presence of a different ambient condition and responsive to sensing the presence of the different ambient condition providing a third condition indicating signal having a second amplitude, where the first amplitude is different from the second amplitude.

9. The method as in claim 7 which includes providing a selected voltage which exceeds the first amplitude.

10. The method as in claim 9 which includes reducing the selected voltage to a first value in the presence of the selected ambient condition and reducing the selected voltage to the first value in the presence of the trouble indicating condition.

11. The method as in claim 10 which includes reducing the selected voltage to a second value, less than the first value in response to detecting a second ambient condition.

12. A system having:

a plurality of detectors with each detector in communication, via a common medium, with a common displaced, control element;

at least some of the detectors each include circuitry that senses the presence of a selected ambient condition, and circuitry to indicate a trouble condition; and a respective interface circuitry of each of the at least some detectors that asserts a first indicating signal having a first amplitude and a first duty cycle to indicate the selected ambient condition and that asserts a second indicating signal having the first amplitude and a second duty cycle to indicate the trouble condition, the interface circuitry coupling the asserted first and second indicating signals to a control panel through a two-wire loop having a plurality of other associated detectors, where the first amplitude is between a normal open circuit voltage of the two-wire loop and a minimum operating voltage of the other associated detectors, the detector relating signaling of the first and second indicating signals are transparent to operation of the other associated directors, and where the respective interface circuit is coupled between each of the at least some detectors and the two-wire loop.

13. The system as in claim 12 where some of the detectors are different than others of the plurality of detectors.

14. The system as in claim 13 where some members of the plurality of detectors are fire detectors, and others are gas detectors.

15. The system as in claim 14 where the fire detectors assert a third indicating signal having a second amplitude in the presence of fire, where the gas detectors assert the first indicating signal having the first amplitude and the first duty cycle in the presence of gas, and where at least some of the detectors can indicate a trouble condition by asserting the second indicating signal having the first amplitude and the second duty cycle.

16. The system as in claim 15 where the control element couples a selected voltage to the detectors via the common medium, and values of the asserted first, second, and third indicating signals are less than the selected voltage.

17. The system as in claim 15 wherein another detector is coupled to the common medium and responds to ambient gas.

* * * * *